US012760976B2

(12) United States Patent
Eisl et al.

(10) Patent No.: US 12,760,976 B2
(45) Date of Patent: Oct. 13, 2026

(54) HEAT EXCHANGER COMPRISING AN ULTRASOUND SENSOR FOR DETERMINING A TUBE WALL THICKNESS OF A HEAT-EXCHANGER TUBE OF THE HEAT EXCHANGER AND METHOD FOR OPERATING SUCH A HEAT EXCHANGER

(71) Applicant: Schoeller-Bleckmann Nitec GmbH, Ternitz (AT)

(72) Inventors: Daniel Eisl, Fuschl am See (AT); Manuel Prohaska, Trofaiach (AT); Aleksandra Gavrilovic-Wohlmuther, Pitten (AT)

(73) Assignee: Schoeller-Bleckmann Nitec GmbH, Ternitz (AT)

( * ) Notice: Subject to any disclaimer, the term of this patent is extended or adjusted under 35 U.S.C. 154(b) by 101 days.

(21) Appl. No.: 18/840,624

(22) PCT Filed: Mar. 22, 2023

(86) PCT No.: PCT/EP2023/057324
§ 371 (c)(1),
(2) Date: Aug. 22, 2024

(87) PCT Pub. No.: WO2023/232306
PCT Pub. Date: Dec. 7, 2023

(65) Prior Publication Data

US 2025/0180309 A1 Jun. 5, 2025

(30) Foreign Application Priority Data

May 30, 2022 (EP) ..... 22176172

(51) Int. Cl.
*F28F 27/00* (2006.01)
*F28D 21/00* (2006.01)

(52) U.S. Cl.
CPC ..... *F28F 27/00* (2013.01); *F28D 2021/0022* (2013.01); *F28F 2275/08* (2013.01)

(58) Field of Classification Search
CPC ..... F28F 27/00; F28F 2275/08; F28D 2021/0022
(Continued)

(56) References Cited

U.S. PATENT DOCUMENTS 4,505,323 A * 3/1985 de la Pintiere ..... F22B 37/003 165/11.2
4,872,347 A * 10/1989 Okabe ..... G01N 29/28 73/622
(Continued)

FOREIGN PATENT DOCUMENTS

EP 3 569 305 11/2019

OTHER PUBLICATIONS

Int'l Search Report (SR) (Form PCT/ISA/210) conducted in Int'l Appln. No. PCT/EP2023/057324 (Jul. 18, 2023).
(Continued)

*Primary Examiner* — Claire E Rojohn, III
(74) *Attorney, Agent, or Firm* — GREENBLUM & BERNSTEIN, P.L.C.

(57) ABSTRACT

A heat exchanger and method for operating heat exchanger, the heat exchanger includes multiple heat-transfer tubes for transporting a first fluid in order to transfer heat between the first fluid and a second fluid via the heat-transfer tubes. In order to increase a usability, it is provided that an ultrasound sensor is respectively arranged on one or more of the heat-transfer tubes for the in situ determination of tube wall thicknesses of the heat-transfer tubes. The respective ultrasound sensor is designed for a working pressure of more than 30 bar and/or a working temperature of more than 80° C., and the respective ultrasound sensor is connected to an
(Continued)

electronic data acquisition unit for the transfer of data, in order to transfer measurement data to the electronic data acquisition unit during operation of the heat exchanger.

16 Claims, 3 Drawing Sheets

(58) Field of Classification Search
USPC ..... 165/200
See application file for complete search history.

(56) References Cited

U.S. PATENT DOCUMENTS 5,025,215 A * 6/1991 Pirl ..... G01N 29/225 73/866.5
5,892,162 A * 4/1999 Spinks ..... G01S 7/521 73/591
5,992,250 A * 11/1999 Kluth ..... G02B 6/52 73/866.5
6,532,839 B1 * 3/2003 Kluth ..... E21B 47/007 73/866.5
7,019,520 B2 * 3/2006 Kwun ..... G01N 27/82 324/238
7,647,829 B2 * 1/2010 Junker ..... G01N 29/041 73/620
9,127,896 B1 * 9/2015 Nehlen, III ..... B01D 29/012
9,302,205 B1 * 4/2016 Nehlen, III ..... C02F 1/685
9,488,619 B2 * 11/2016 Nesic ..... G01N 17/008
10,041,911 B2 8/2018 Bonadies, Jr. et al.
11,542,690 B2 * 1/2023 Gibson ..... F16L 55/1155
12,038,242 B2 * 7/2024 Glass, III ..... G01N 29/2475
12,092,613 B2 * 9/2024 Al-Jabr ..... G01N 29/07
12,216,092 B2 * 2/2025 Brignac ..... G01N 29/265
12,253,216 B2 * 3/2025 Halvorsen ..... F17C 13/025
2015/0260690 A1 * 9/2015 Rasselkorde ..... G01N 29/28 73/623
2020/0388410 A1 * 12/2020 Glass, III ..... G01N 29/2475
2021/0187471 A1 * 6/2021 Serraiocco ..... F28D 7/16
2022/0334582 A1 * 10/2022 Bryner ..... B60B 19/12
2023/0298327 A1 * 9/2023 Katayama ..... G06V 10/774 382/145
2025/0180309 A1 * 6/2025 Eisl ..... F28D 7/16
2025/0305781 A1 * 10/2025 Djinovic ..... G01B 11/06

OTHER PUBLICATIONS

Int'l Written Opinion (WO) (Form PCT/ISA/237) conducted in Int'l Appln. No. PCT/EP2023/057324 (Jul. 18, 2023).
United Arab Emirates Office Action conducted in counterpart UAE Appln. No. P2024-03220 (May 24, 2026).

* cited by examiner

HEAT EXCHANGER COMPRISING AN ULTRASOUND SENSOR FOR DETERMINING A TUBE WALL THICKNESS OF A HEAT-EXCHANGER TUBE OF THE HEAT EXCHANGER AND METHOD FOR OPERATING SUCH A HEAT EXCHANGER

The invention relates to a heat exchanger, in particular a high-pressure heat exchanger for urea synthesis, comprising multiple heat-transfer tubes for transporting a first fluid in order to transfer heat between the first fluid and a second fluid via the heat-transfer tubes.

The invention furthermore relates to a method for operating a heat exchanger.

It is known from the prior art to use a heat exchanger to exchange thermal energy between a first fluid stream and a second fluid stream. The heat exchanger often comprises multiple heat-transfer tubes for transporting the first fluid stream, in order to transfer heat to a second fluid stream flowing around the heat-transfer tubes, or to absorb heat from said second fluid stream, via the heat-transfer tubes. As part of a urea synthesis, heat exchangers are typically used in which the first or second fluid stream has a high pressure, normally more than 30 bar, and a high temperature, normally of more than 80° C. The transport of the first fluid stream through the heat-transfer tubes is thereby often associated with an, in particular corrosive and/or erosive, removal of tube wall material of the heat-transfer tubes or a formation of deposits respectively in an interior of the heat-transfer tubes, so that a tube wall thickness of the heat-transfer tubes changes, in particular decreases, during operation of the heat exchanger. A diminution of a tube wall integrity of the heat-transfer tubes can be problematic for a safety of operation of the heat exchanger. Therefore, it is typically necessary, based on chronological maintenance intervals, to regularly shut down the heat exchanger and measure tube wall thicknesses of the heat-transfer tubes.

For this purpose, it is typical to insert a measuring probe into the respective heat-transfer tube in a non-operating state of the heat exchanger, in order to determine an inner radius or a tube wall thickness of the heat-transfer tube. Measuring probes are known which comprise an ultrasound sensor, an optical sensor, or an eddy current sensor in order to determine the tube wall thickness.

Particularly in the case of heat exchangers that work with pressures of more than 30 bar and high temperatures of more than 80° C. of the first and/or second fluid stream, a service interruption of this type for determining tube wall thicknesses of the heat-transfer tubes is normally laborious and associated with high costs.

This is addressed by the invention. The object of the invention is to specify a heat exchanger of the type named at the outset which has an optimized usability, in particular an optimized operation.

It is also an object of the invention to specify a method for operating a heat exchanger which enables an optimized use or operation of the heat exchanger.

According to the invention, the object is attained in that, with a heat exchanger of the type named at the outset, an ultrasound sensor is respectively arranged on one or more of the heat-transfer tubes for the in situ determination of tube wall thicknesses of the heat-transfer tubes, wherein the respective ultrasound sensor is designed for a working pressure of more than 30 bar and/or a working temperature of more than 80° C., wherein the respective ultrasound sensor is connected to an electronic data acquisition unit for the transfer of data, in order to transfer measurement data to the electronic data acquisition unit during operation of the heat exchanger.

The basis of the invention is the idea of improving a usability of heat exchangers that are designed for a high operating pressure and/or high operating temperature of the first and/or second fluid, in that a tube wall thickness of heat-transfer tubes of the heat exchanger is determined in situ, that is, locally on the heat exchanger or the heat-transfer tubes, and typically in operando, that is, during operation of the heat exchanger. As a result, an operation, in particular a process management, and/or a maintenance of the heat exchanger can take place depending on the determined tube wall thickness. Specifically, it is not necessary to interrupt operation of the heat exchanger in order to determine the tube wall thickness.

Operation of the heat exchanger denotes a state in which the first fluid is conducted through the heat-transfer tubes in order to exchange heat with the second fluid via the heat-transfer tubes. A high operating pressure and a high operating temperature denote an operating pressure of the first fluid and/or of the second fluid of greater than 30 bar and an operating temperature of greater than 80° C., respectively. In particular, the operating pressure is between 30 bar and 200 bar, preferably approximately 180 bar, and/or the operating temperature is between 80° C. and 300° C., preferably approximately 230° C. Normally, the first and/or second fluid has during operation of the heat exchanger an operating pressure of this type and an operating temperature of this type, or the heat exchanger is designed for operation of this type. Accordingly, it is beneficial if the respective ultrasound sensor has a working pressure and a working temperature corresponding to the operating pressure and the operating temperature, respectively. The heat exchanger is preferably a high-pressure heat exchanger.

It is particularly beneficial if the heat exchanger is a stripper for carrying out a stripping. It is beneficial if the stripper is used for urea synthesis. The stripper can be embodied to synthesize urea by stripping, normally inside the heat-transfer tubes.

Typically, the respective ultrasound sensor is arranged on the respective heat-transfer tube such that the ultrasound sensor is located in one of the fluids, preferably in the second fluid, during operation of the heat exchanger. It has proven effective if the respective ultrasound sensor is arranged on an outside of the heat-transfer tube, typically in the second fluid during operation of the heat exchanger. Normally, during operation of the heat exchanger, the second fluid has the aforementioned operating pressure and/or aforementioned operating temperature, or the heat exchanger is embodied for operation of this type. The ultrasound sensor is typically arranged on a tube wall of the respective heat-transfer tube, in order to determine the tube wall thickness by emitting an ultrasound signal into the tube wall. Normally, an ultrasound signal can be emitted and a reflected ultrasound signal detected using the ultrasound sensor. The heat exchanger typically comprises one, preferably multiple, ultrasound sensors of this type. Typically, the heat exchanger or ultrasound sensor is embodied for the in situ determination and in operando determination of a tube wall thickness of the respective heat-transfer tube, or a tube wall thickness of the respective heat-transfer tube is determined in situ and in operando using the ultrasound sensor.

It is expedient if the respective ultrasound sensor is connected to an electronic data acquisition unit for the transfer of data. As a result, measurement data can be transferred from the ultrasound sensor to the data acquisition unit during operation of the heat exchanger. For the transfer of data, the ultrasound sensor and the data acquisition unit are typically connected to an, in particular electrical, signal line. Preferably, the signal line is embodied for a symmetrical signal transfer. The signal line is typically embodied in the form of a cable. The signal line is preferably a coaxial cable. Multiple electronic data acquisition units can be provided, wherein different ultrasound sensors can be connected to various of the electronic data acquisition units for the transfer of data. A plurality of the ultrasound sensors can be connected to the same electronic data acquisition unit for the transfer of data. It can be provided that the respective ultrasound sensor is controlled using the electronic data acquisition unit to which the ultrasound sensor is connected for the transfer of data.

The heat-transfer tubes are typically embodied for conducting the first fluid in order to transfer heat between the first fluid and the second fluid through tube walls of the heat-transfer tubes. It is preferably provided that, during operation of the heat exchanger, the second fluid is in, in particular direct, contact with the heat-transfer tubes or the tube walls. The first fluid is typically a first fluid stream conducted through the heat-transfer tubes during operation of the heat exchanger. During operation of the heat exchanger, the second fluid can be a second fluid stream that normally flows around the heat-transfer tubes. The second fluid typically has a pressure of more than 30 bar, in particular between 30 bar and 200 bar, preferably approximately 180 bar, and/or a temperature of more than 80° C., in particular between 80° C. and 300° C., preferably approximately 230° C. The first fluid can have a higher pressure and/or a higher temperature than the second fluid.

The heat exchanger typically has a fluid chamber for accommodating the second fluid, wherein the heat-transfer tubes run inside of the fluid chamber. The fluid chamber typically forms a fluid chamber cavity between fluid chamber walls of the fluid chamber and the heat-transfer tubes, in order to accommodate the second fluid with the fluid chamber cavity for a transfer of heat between the first fluid and the second fluid. The heat-transfer tubes typically run through the fluid chamber cavity. Normally, it is provided that, during operation of the heat exchanger, the second fluid is conducted through the fluid chamber cavity, in particular such that the second fluid flows around the heat-transfer tubes. Expediently, the fluid chamber cavity can be embodied in the form of one or more channels, in order to conduct the second fluid using the channels during operation of the heat exchanger. The fluid chamber typically comprises at least one fluid chamber inlet and at least one fluid chamber outlet, in order to conduct the second fluid into the fluid chamber, in particular the fluid chamber cavity, via the fluid chamber inlet and to remove the second fluid, normally after heat transfer has occurred between the first fluid and second fluid, again from the fluid chamber, in particular the fluid chamber cavity, via the fluid chamber outlet. The fluid chamber is typically formed such that it comprises, in particular is made of, metal, preferably an iron alloy, particularly preferably a steel alloy, for example austenitic steel.

Normally, heat-transfer tubes are spaced apart from one another at least in sections, so that during operation of the heat exchanger, the second fluid can flow through between the heat-transfer tubes for a transfer of heat with the heat-transfer tubes. This applies in particular inside of the fluid chamber, or the fluid chamber cavity thereof.

Typically, the first fluid and the second fluid are embodied to be liquid and/or gaseous. For example, the first fluid and the second fluid can be formed such that they comprise, in particular are made of, liquid and gaseous water. It can be provided that the first fluid and second fluid are embodied such that they comprise, in particular are made of, a liquid medium and a gaseous medium, wherein during operation of the heat exchanger the liquid medium and the gaseous medium of the respective fluid flow through the heat exchanger in opposing directions, typically such that they contact one another. For example, the first fluid can be formed such that it comprises a liquid medium and a gaseous medium, wherein in the respective heat-transfer tube, the media flow through the heat-transfer tube in opposing directions, in particular such that they contact one another, during operation of the heat exchanger.

The heat-transfer tubes typically extend between a first tube plate and a second tube plate, wherein the tube plates delimit the fluid chamber cavity for accommodating the second fluid, wherein the heat-transfer tubes end in pass-through openings of the respective tube plate or are guided through the pass-through openings. Typically, a fluid fed through pass-through openings of one of the plates is conducted through the heat-transfer tubes to the pass-through openings of the other tube plate. The heat-transfer tubes are normally connected to the tube plates in a fluid-tight manner. Typically, the respective tube plate is embodied to be plate-shaped with multiple flow channels oriented transversely, in particular orthogonally, to a longitudinal extension of the tube plate, which flow channels form the respective pass-through openings. The tube plates can be embodied as parts of fluid chamber walls of the fluid chamber. The heat exchanger typically comprises at least one first and at least one second tube plate of this type. The tube plates are typically formed such that they comprise, in particular are made of, metal, preferably an iron alloy, particularly preferably a steel alloy, for example austenitic steel.

In the fluid chamber, one or more fluid-guiding surfaces can be present in order to define a flow path of the second fluid using the fluid-guiding surfaces. The respective fluid-guiding surface is typically embodied to inhibit, in sections, a fluid flow of the second fluid between the heat-transfer tubes. The fluid-guiding surfaces can define a flow path with multiple deflecting curves, along which fluid path the second fluid is guided from the fluid chamber inlet to the fluid chamber outlet. For example, the flow path can have a meandering shape. Typically, a plurality of the heat-transfer tubes run through the respective guiding surface. Normally, multiple guiding surfaces are provided which cross the heat-transfer tubes and are spaced apart from one another. The respective fluid-guiding surface is typically oriented transversely, in particular orthogonally, to a longitudinal extension of the heat-transfer tubes. Normally, multiple fluid-guiding surfaces are provided which are spaced apart from one another in a longitudinal direction of the heat-transfer tubes. Typically, an intermediate space between a plurality of the heat-transfer tubes is essentially closed off by the respective fluid-guiding surface, in order to inhibit a flow of the second fluid through the intermediate space. The respective fluid-guiding surface can be embodied to close off a majority of the intermediate spaces between the heat-treatment tubes to a flow of the second fluid in a cross section through the fluid chamber. The fluid-guiding surfaces can be formed using guide walls arranged in the fluid chamber. The fluid-guiding surfaces are normally embodied to be plate-shaped. The fluid chamber normally comprises one or more guiding surfaces of this type.

Typically, a plurality of the heat-transfer tubes is connected to one another by stabilizing elements in order to stabilize the heat-transfer tubes during operation of the heat exchanger. The respective stabilizing element can be embodied to be plate-shaped, wherein a longitudinal extension of the stabilizing element is normally oriented transversely, in particular orthogonally, to a longitudinal extension of the heat-transfer tubes connected by the stabilizing element. Typically, the heat-transfer tubes run through the stabilizing element. The stabilizing elements are customarily referred to as baffles. Normally, multiple stabilizing elements which are spaced apart from one another and connect the heat-transfer tubes to one another are provided along a longitudinal extension of the heat-transfer tubes. In particular, the fluid-guiding surfaces can be formed by the stabilizing elements. The stabilizing elements can then serve both to stabilize the heat-transfer tubes and to define a flow path of the second fluid.

It is beneficial if the respective ultrasound sensor is arranged in an arrangement region on the respective heat-transfer tube, wherein the arrangement region, in particular in a flow direction of the first fluid through the heat-transfer tube, is defined by a first third of a longitudinal extension of the heat-transfer tube inside of the fluid chamber or of the fluid chamber cavity. The arrangement region of the respective heat-transfer tube extends, in particular in a flow direction of the first fluid, typically starting from an entry of the heat-transfer tube into the fluid chamber, along a longitudinal extension of the heat-transfer tube with a length of 30%, in particular 20%, preferably 10% of a longitudinal extension of the heat-transfer tube inside of the fluid chamber or the fluid chamber cavity. It has been shown that a material removal or a wear of the heat-transfer tube is normally especially large in this arrangement region of the respective heat-transfer tube, for which reason it is beneficial to position the ultrasound sensors in said region.

It is advantageous if the electronic data acquisition unit is arranged outside of the fluid chamber, in particular of the fluid chamber cavity. As a result, the electronic data acquisition unit is protected against loads, in particular pressure loads, and/or temperature loads, in particular of the first and second fluid. The data acquisition unit typically comprises a microcontroller or can be embodied as a computer. The electronic data acquisition unit is normally embodied to receive measurement data, in most cases via one or more hardware interfaces, from one or more of the ultrasound sensors. The electronic data acquisition unit can be embodied to process, to collect, and/or to transmit the measurement data. For example, measurement data can be transmitted from the electronic data acquisition unit to an electronic central data unit, which electronic central data unit can be embodied to output, particularly in a processed manner, data and/or to display said data to a user. Typically, the heat exchanger comprises one or more electronic data acquisition units.

It has proven effective if the respective ultrasound sensor is connected to the data acquisition unit for the transfer of data via the signal line, wherein the signal line runs in particular in the fluid chamber, at least in sections inside of a protective tube, preferably made of metal, in order to protect the signal line, in particular against a loading by the first or second fluid. It is advantageous if the protective tube forms a volume separated from the first fluid and second fluid, inside of which volume, in particular through which volume, the signal line runs. Expediently, the protective tube can be connected in a corresponding manner to the ultrasound sensor. The volume is typically separated from the fluid chamber cavity. Typically, the signal line runs inside of the protective tube in the fluid chamber. The protective tube normally extends from the respective ultrasound sensor to a fluid chamber wall of the fluid chamber, in particular of the fluid chamber cavity. It is advantageous if the protective tube is connected to a sensor housing of the respective ultrasound sensor such that the protective tube, preferably together with the sensor housing, defines a volume separated from the first fluid and second fluid, or a volume separated from the fluid chamber cavity, during operation of the heat exchanger, in which volume the signal line runs. The protective tube is typically connected in a fluid-tight manner to the respective ultrasound sensor, in particular to the sensor housing thereof. The protective tube can be connected in a fluid-tight manner to a fluid chamber wall of the fluid chamber, in particular of the fluid chamber cavity, or be guided through the fluid chamber wall. The fluid chamber can comprise a signal line feed-through, with which the signal line is guided through a fluid chamber wall of the fluid chamber, in particular is guided out of the fluid chamber. Expediently, the protective tube can be connected in a fluid-tight manner to the fluid chamber wall via the signal line feed-through. Typically, essentially the entire length of the signal line extends inside of the protective tube between the ultrasound sensor and the fluid chamber wall or signal line feed-through.

The protective tube can be connected, typically in a fluid-tight manner, to the ultrasound sensor, in particular to the sensor housing thereof, in a force-fitting, form-fitting, and/or materially bonded manner. The protective tube can be connected, typically in a fluid-tight manner, to the signal line feed-through or a fluid chamber wall in a force-fitting, form-fitting, and/or materially bonded manner. It is preferably provided that on one side the protective tube is connected in a materially bonded manner, in particular welded, to the respective ultrasound sensor, in particular to the sensor housing thereof, and/or on the other side the protective tube connects, preferably in a force-fitting and/or materially bonded manner, by means of a wedge-bolt connection, to a signal line feed-through with which the signal line is guided through the fluid chamber. The welded connection enables a loadable and space-saving connection on the ultrasound sensor. On the fluid chamber wall, or on the signal line feed-through, a space requirement for the connection of the protective tube is typically less relevant, for which reason a wedge-bolt connection is practicable. Alternatively, however, the protective tube can also be connected in a materially bonded manner, in particular welded, to the fluid chamber wall or the signal line feed-through. The heat exchanger preferably comprises one or more protective tubes of this type. In particular, multiple protective tubes connected to various of the ultrasound sensors can be connected to one another such that they form a shared volume, in order to guide the respective signal lines through the shared volume.

The protective tube is typically formed such that it comprises, in particular is made of, metal. Preferably, the protective tube is formed such that it comprises, in particular is made of, an iron alloy, preferably steel alloy, preferably austenitic steel. In this manner, a different atmosphere, in particular atmospheric element composition, can preferably be created inside of the protective tube, or inside of the ultrasound sensor, than in the fluid chamber. The atmosphere, in particular atmospheric element composition, inside of the protective tube, or inside of the ultrasound sensor, can essentially correspond to an ambient atmosphere of the heat exchanger.

The respective ultrasound sensor is typically embodied to emit an ultrasound signal and to receive an ultrasound signal that is reflected, typically against one or more interfaces. The ultrasound signal is normally an ultrasound wave. From a time interval, in particular a comparison, between an emitted and received ultrasound signal, a distance between the interfaces can be determined. Advantageously, an ultrasound signal can be emitted into the respective heat-transfer tube, specifically the tube wall thereof, using the ultrasound sensor, and ultrasound signals reflected against interfaces, in particular an outer wall and an inner wall of the heat-transfer tube, can be received using the ultrasound sensor, in order to determine a tube wall thickness of the heat-transfer tube. The respective ultrasound sensor typically comprises a piezoelectric crystal for emitting the ultrasound signal and receiving the reflected ultrasound signal. The piezoelectric crystal is typically embodied as part of a piezoelectric element. An actuation of the piezoelectric crystal or piezoelectric element typically occurs via the signal line. It is beneficial if the piezoelectric crystal is formed such that it comprises, in particular is made of, a lead zirconate titanate ceramic (PZT ceramic). The piezoelectric crystal and be embodied to be plate-shaped and, in an emission direction of the ultrasound signal, have a thickness of less than 3 mm, in particular less than 1 mm, preferably less than 0.5 mm, particularly preferably between 0.1 mm and 0.15 mm. The thickness is normally greater than 0.05 mm. The ultrasound sensor is typically arranged on the heat-transfer tube such that the emission direction of the ultrasound signal is transverse, in particular essentially orthogonal, to a longitudinal extension of the heat-transfer tube.

Normally, the respective ultrasound sensor is embodied and in particular arranged on the respective heat-transfer tube, specifically the tube wall thereof, such that an ultrasound signal can be emitted into the respective heat-transfer tube, specifically the tube wall thereof, using the ultrasound sensor and ultrasound signals reflected against an outer wall and an inner wall of the heat-transfer tube, specifically the tube wall thereof, can be received using the ultrasound sensor, in order to determine a tube wall thickness of the heat-transfer tube. From a time interval, in particular a comparison, between emitted and received ultrasound signals, a distance between the inner wall and the outer wall of the heat-transfer tube, specifically the tube wall thereof, can be ascertained, in order to determine the tube wall thickness of the heat-transfer tube. The ultrasound sensor is typically arranged on the heat-transfer tube such that the ultrasound signal is emitted into the heat-transfer tube, specifically the tube wall thereof, in a direction transverse, in particular essentially orthogonal, to the longitudinal axis of the heat-transfer tube using the ultrasound sensor. Expediently, the ultrasound signal can thus strike the outer wall and the inner wall in a direction transverse, in particular essentially orthogonal, to the outer wall and/or the inner wall of the heat-transfer tube, specifically the tube wall thereof, and can in particular be at least partially reflected against said walls.

Typically, the inner wall is an inner surface and the outer wall an outer surface of the tube wall of the heat-transfer tube. Normally, the inner surface is a tube wall surface facing the interior of the heat-transfer tube, and the outer surface is a tube wall surface of the heat-transfer tube facing away from the interior of the heat-transfer tube. This applies in particular in a cross section of the heat transfer tube in a direction orthogonal to the longitudinal axis of the heat-transfer tube.

For a high accuracy, it has proven effective if, in the respective ultrasound sensor, an emission and a receiving of the ultrasound signals occur using the same piezoelectric crystal. Typically, a control of the ultrasound sensor or piezoelectric crystal switches between an emitting mode, in which an ultrasound signal is emitted using the ultrasound sensor, and a receiving mode, in which a reflected ultrasound signal can be detected using the ultrasound sensor. Between the emitting mode and receiving mode, there is typically a dead time in which a reflected ultrasound signal cannot be detected. Alternatively, it can be provided that the ultrasound sensor comprises multiple piezoelectric crystals, wherein one of the piezoelectric crystals is embodied for emitting and another of the piezoelectric crystals for receiving ultrasound signals. However, it is preferred if the emitting and receiving of the ultrasound signals take place using the same piezoelectric crystal.

Typically, the respective ultrasound sensor comprises a damping element, a piezoelectric crystal, and a standoff body. The damping element is normally coupled to the piezoelectric crystal and embodied to dampen mechanical vibrations of the piezoelectric crystal. The piezoelectric crystal often bears against the damping element. The standoff body is normally located downstream from the piezoelectric crystal in an emission direction of an ultrasound signal towards the heat-transfer tube, in order to prevent a reflection of an ultrasound signal emitted using the piezoelectric crystal against a tube wall of the heat-transfer tube during the dead time. The standoff body is normally formed from a material that is suitably ultrasonically conductive.

It is beneficial if, in the respective ultrasound sensor, the damping element, the piezoelectric crystal, and the standoff body are pressed against one another by means of a spring element. In this manner, a robust and, in particular, durable connection can be ensured, even at high working pressure and/or high working temperature. Preferably, it is thereby possible to omit a bonding of the damping element, piezoelectric crystal, and standoff to one another, which bonding is susceptible to loads. The pressing-together is thereby typically associated with an elastic deformation of the spring element against a spring force of the spring element. It is advantageous if the spring element is formed with a spring or an arrangement of multiple springs that are preferably coupled to one another in series connection. The spring is preferably a disc spring. The spring element is preferably arranged upstream from the damping element in an emission direction.

Emission direction typically denotes the direction in which a respective ultrasound sensor is embodied to emit an ultrasound signal, in particular towards the heat-transfer tube.

It is beneficial if the damping element is embodied such that it comprises, in particular is made of, a porous titanium body, formed in particular such that it comprises sintered titanium. Typically, the titanium body has an average pore size of less than 100 μm, in particular less than 50 μm, preferably between 1 μm and 10 μm, particularly preferably approximately 5 μm. It is thus possible to produce a robust ultrasound signal. The damping element typically has a thickness between 1 mm and 5 mm, preferably approximately 3 mm, in an emission direction.

The standoff body can be formed such that it comprises, in particular is made of, acrylic glass or a metal, in particular iron, preferably steel. For a robust ultrasound signal, it is particularly beneficial if the standoff body is formed such that it comprises, in particular is made of, austenitic steel. Preferably, a surface of the standoff body is thereby embodied in a polished manner, in particular if the standoff body is formed such that it comprises or is made of steel. Typically, the standoff body has a thickness of less than 30 mm, in particular between 2 mm and 10 mm, preferably approximately 5 mm, in an emission direction.

It is advantageous if, in the respective ultrasound sensor, the damping element is arranged between an electrical actuating electrode and the piezoelectric crystal, wherein the damping element is embodied to be electrically conductive, so that an electrical actuation of the piezoelectric crystal via the actuating electrode can be realized through the damping element. The electrical actuating electrode can be pressed against the damping element using the aforementioned spring element. It shall be understood that two electrodes are normally present in order to electrically actuate the piezoelectric crystal for the emitting and receiving of an ultrasound signal, in particular to apply an electric voltage to said crystal or to decrease an electric voltage via the electrodes. The electrodes are typically electrically connected to the piezoelectric crystal on opposite sides of the piezoelectric crystal.

One of the electrodes can be the actuating electrode and can be electrically connected to the piezoelectric crystal via the damping element, in particular in the aforementioned manner. The other electrode can be directly electrically connected to the piezoelectric crystal, typically on a side of the piezoelectric crystal located downstream from the piezoelectric crystal in an emission direction. Alternatively or cumulatively, it is beneficial if, for the formation of a piezoelectric element, two piezo electrodes are applied to surfaces of the piezoelectric crystal, typically such that they lie opposite one another on the piezoelectric crystal, via which piezo electrodes the piezoelectric crystal can be actuated to stimulate vibration. The piezo electrodes are typically made of metal, preferably silver. Advantageously, aforementioned actuating electrodes can additionally be provided.

The respective ultrasound sensor typically comprises a sensor housing which forms an outer jacket of the ultrasound sensor. Normally, the damping element, the piezoelectric crystal, typically essentially the standoff body, and/or normally the electrodes, in particular the actuating electrode if necessary, are arranged inside of the sensor housing. The sensor housing typically comprises an outlet opening via which an ultrasound signal produced using the piezoelectric crystal can exit for a measurement using the ultrasound sensor. The outlet opening is typically closed off in a fluid-tight manner, often with the standoff body.

It has proven effective if the respective ultrasound sensor comprises one or more electric insulating elements for electric insulation between the sensor housing of the ultrasound sensor and, respectively, the piezoelectric crystal of the ultrasound sensor and/or the damping element of the ultrasound sensor and/or one, in particular multiple, electrodes of the ultrasound sensor. The electric insulating elements are preferably formed such that they comprise, in particular are made of, zirconium dioxide. The electric insulating elements can surround these components entirely. In this manner, a risk of an electrical short circuit can be minimized even under a high load, in particular a pressure load and/or temperature load.

It is advantageous if, between the respective ultrasound sensor and the heat-transfer tube, a coupling means formed such that it comprises silver, in particular a silver film, is arranged, or if no coupling means is arranged. This applies in particular during operation of the heat exchanger. It is typically the purpose of the coupling means to enable a reduced-reflection coupling of the ultrasound signal into the heat-transfer tube. It has been shown that, with an aforementioned high pressure and/or an aforementioned high temperature, a sustainable high-quality coupling-in can be obtained, if silver is used as a coupling means, or if no coupling means is used. The coupling means is preferably embodied to be layered. The coupling means often has a thickness between 0.01 mm and 1 mm, in particular approximately 0.05 mm. The thickness is typically measured in an emission direction.

The respective ultrasound sensor can be connected to the respective heat-transfer tube in a force-fitting, form-fitting, or materially bonded manner. Expediently, a retaining device can be provided for this purpose. It is preferred if the respective ultrasound sensor is connected to the respective heat-transfer tube in a force-fitting manner, preferably using a clamping connection. In this manner, a robust connection between the ultrasound sensor and heat-transfer tube is enabled in order to allow a low-noise coupling of the ultrasound signal into the heat-transfer tube, without the measurement object being significantly impaired thereby with regard to the measurement of the tube wall thickness. It is beneficial if the retaining device comprises a spring component, wherein the ultrasound sensor is pressed against the tube wall of the heat-transfer tube with a spring force load using the spring component. As a result, a strong pressing contact can be ensured, even under, in particular variable, pressure and/or temperature loads. The spring component can be formed such that it comprises one or more disc springs. Expediently, a plurality of the ultrasound sensors can respectively be connected to the respective heat-transfer tube to using a separate retaining device, in particular as described. However, it can also be provided that a plurality of the ultrasound sensors is connected to the respective heat-transfer tube using a shared retaining device. Though less preferable, the respective ultrasound sensor can alternatively be connected to the heat-transfer tube in a materially bonded manner or, in simple cases, in a form-fitting manner.

It is advantageous if multiple ultrasound sensors are connected to the same electronic data acquisition unit for the transfer of data, in order to transfer measurement data to the electronic data acquisition unit during operation of the heat exchanger. In this manner, a compact construction having preferably short signal lines can be realized. Typically, the electronic data acquisition unit comprises multiple hardware interfaces to which signal lines connected to the ultrasound sensors for the transfer of data are connected. One hardware interface each can be respectively assigned to one of the signal lines. The respective ultrasound sensor can be connected by a single signal line to the electronic data acquisition for the transfer of data. Alternatively, a plurality of the signal lines connected to the ultrasound sensors can form a shared data bus, via which measurement data can be transferred to the electronic data acquisition unit. It is beneficial if multiple electronic data acquisition units are present, wherein the ultrasound sensors from different groups of electronic ultrasound sensors are connected to different electronic data acquisition units for the transfer of data. This is particularly beneficial for keeping signal line lengths short.

It is advantageous if, for the transfer of data, multiple electronic data acquisition units are connected to an electronic central data unit, wherein the electronic central data unit is embodied to collect the measurement data of the electronic data acquisition units and/or to process said data and/or to make said data available for a readout by a user. The measurement data can thereby already be preprocessed by the electronic data acquisition units, and can be further processed by the electronic central data unit, for example. In particular, the electronic data acquisition units and/or the electronic central data unit can be embodied to determine, from the measurement data, a tube wall thickness of the heat-transfer tube, specifically the tube wall thereof, measured using the respective ultrasound sensor. For a transfer of data, the electronic data acquisition units can be connected to the electronic central data unit via data transfer lines, in particular in the form of a data bus. In this manner, a compact design with little interference potential for the measurement data, in particular as a result of the high pressure and/or high temperature conditions in the heat exchanger, can be realized. The electronic central data unit typically comprises a microcontroller or can be embodied as a computer. Preferably, the heat exchanger comprises one or more electronic central data units.

The heat exchanger is typically designed for an operating pressure of greater than 30 bar, in particular between 30 bar and 200 bar, preferably approximately 180 bar, and/or an operating temperature of greater than 80° C., in particular between 80° C. and 300° C., preferably approximately 230° C., or is operated correspondingly. Accordingly, it is beneficial if the respective ultrasound sensor is designed for a use at an operating pressure of this type and/or an operating temperature of this type, or has a working pressure of this type and/or a working temperature of this type. The operating pressure and the operating temperature typically refer to the first fluid and/or second fluid. Preferably, the second fluid has an operating pressure of this type and/or an operating temperature of this type during operation of the heat exchanger. Normally, the respective ultrasound sensor is located inside of the second fluid during operation of the heat exchanger. Accordingly, it is beneficial if the respective ultrasound sensor is designed for a working pressure that corresponds to the operating pressure and a working temperature that corresponds to the operating pressure of the second fluid.

The respective ultrasound sensor is typically arranged on a tube wall of the respective heat-transfer tube, in particular such that it contacts the tube wall. Typically, one ultrasound sensor is respectively arranged on a plurality of the heat-transfer tubes of the heat exchanger. Multiple ultrasound sensors can also be respectively arranged on a plurality of the heat-transfer tubes. The heat-transfer tubes are normally formed such that they comprise, in particular are made of, metal, in particular an iron alloy, preferably a steel alloy.

Typically, the electronic data acquisition unit is arranged outside of the first fluid and second fluid, or outside of a heat-transfer space of the heat exchanger, in which heat-transfer space heat is transferred between the first fluid and the second fluid via the heat-transfer tubes during operation of the heat exchanger. The heat-transfer space can be the fluid chamber or enclose the fluid chamber.

It is beneficial if, in this manner, a tube wall thickness of a heat-transfer tube can be determined with an accuracy of less then 0.1 mm, in particular between 0.003 mm and 0.1 mm, typically 0.05 mm, during operation of the heat exchanger. This can be achieved using a heat exchanger according to the present document.

The other object is attained by a method of the type named at the outset for operating a heat exchanger if, on one or more heat-transfer tubes of the heat exchanger with which a first fluid is transported in order to transfer heat between the first fluid and a second fluid via the heat-transfer tubes, an ultrasound sensor is respectively arranged with a working pressure of more than 30 bar and/or a working temperature of more than 80° C., wherein a tube wall thickness of the respective heat-transfer tube is determined in situ using the respective ultrasound sensor, wherein measurement data from the respective ultrasound sensor is transmitted to an electronic data acquisition unit during operation of the heat exchanger. The method can in particular be implemented using an aforementioned heat exchanger. Typically, the tube wall thickness of the heat-transfer tube denotes, in a cross section of the heat-transfer tube, an, in particular radial, distance between an inner surface and an outer surface of a tube wall of the heat-transfer tube. Typically, the second fluid is located outside of the heat-transfer tubes, so that heat is transferred between the first fluid and second fluid through the tube walls of the heat-transfer tubes.

It shall be understood that the method for operating a heat exchanger can be embodied according to the features and effects which are described, in particular in the foregoing, in the present document within the scope of a heat exchanger. The same also applies to the heat exchanger with regard to the method.

It is particularly beneficial if the method for operating the heat exchanger is used for urea synthesis. The heat exchanger can, in particular for urea synthesis, be embodied as a stripper for stripping, wherein it is typically provided that a liquid phase and gas phase having opposing flow directions are brought into contact with one another, normally inside of the heat-transfer tubes. It is beneficial if a first medium flows through the respective heat-transfer tube in a flow direction and a second medium flows through the heat-transfer tube in a direction opposed to the flow direction, in order to react with one another, wherein one of the media is normally liquid and the other medium is gaseous. The typically takes place inside of the fluid chamber or of the fluid chamber cavity. The first fluid can be formed such that it comprises or is made of the first medium and second medium. It is beneficial if the heat-transfer tubes and a flow direction of the first fluid through the heat-transfer tubes are oriented essentially vertically, particularly if the heat exchanger is a stripper. The heat exchanger or stripper normally comprises a plurality, in particular more than 10, preferably more than 50, especially preferably more than 100, particularly preferably more than 1000, heat-transfer tubes.

Typically, the heat exchanger, particularly if said heat exchanger is a stripper, comprises a first inlet, via which the first medium can be fed into the heat-transfer tubes, and a second inlet, via which the second medium can be fed into the heat-transfer tubes, so that inside of the fluid chamber or the fluid chamber cavity, the media flow through the heat-transfer tubes with opposing flow directions in order to react with one another. In relation to the fluid chamber cavity, the first inlet and the second inlet are typically arranged at different ends of the heat-transfer tubes such that they are connected to the heat-transfer tubes in a fluid-conducting manner. The heat exchanger normally comprises at least one outlet for removing from the heat-transfer tubes a product formed by a reaction between the first medium and the second medium. Practicably, the heat exchanger can comprise a first outlet, via which a first product can be removed from the heat-transfer tubes, and a second outlet, via which a second product can be removed from the heat-transfer tubes, wherein in relation to the fluid chamber cavity, the outlets are connected to the heat-transfer tubes in a fluid-conducting manner at different ends of the heat-transfer tubes. The first product and second product are typically formed by means of or as a result of the reaction between the first medium and second medium. This applies in particular if the heat exchanger is embodied as a stripper.

For urea synthesis, the first medium is typically formed such that it comprises, in particular is made of, urea, ammonium carbamate, and ammonia, and the second medium is formed such that it comprises, in particular is made of, gaseous carbon dioxide ($CO_2$). In this manner, urea, in particular of high purity, can be separated as a product, in particular a first product, which urea is conducted out of the heat-transfer tube, typically at one of the ends of the heat-transfer tube or via the first outlet. Expediently, formed process gas, normally gaseous ammonia ($NH_3$) and/or gaseous carbon dioxide ($CO_2$), can be conducted out of the heat-transfer tube, usually at another end of the heat-transfer tube or via the second outlet. The second fluid can be formed such that it comprises, in particular is made of, liquid and/or gaseous water. The stripper can be embodied and operated as described in the present document, in particular with regard to the heat exchanger.

It is beneficial if the respective ultrasound sensor is operated at a frequency, in particular a center frequency, of more than 10 MHz, in particular between 10 MHz and 30 MHz, in particular if ultrasound signals having a corresponding frequency are emitted from the respective ultrasound sensor for determining the tube wall thickness. The frequency, in particular the center frequency, is preferably approximately 15 MHz.

It is advantageous if, for the temperature compensation of an ultrasonic speed of the ultrasound signal, a thickness of the standoff body of at least one of the ultrasound sensors is used as a reference length, and/or a temperature is ascertained using at least one thermocouple. Because the standoff body has a known thickness, a change in the sonic speed of the ultrasound signal can be factored in, in particular, determined, by ascertaining a thickness of the standoff body by means of the ultrasound measurement, in particular by means of the measurement signals, of the respective ultrasound sensor. The thickness is typically measured in an emission direction. Expediently, a temperature compensation can be carried out during each measuring procedure using the respective ultrasound sensor. A high accuracy of the measurement is thus obtainable. The temperature compensation can be factored in during a determination, in particular calculation, of the tube wall thickness from the measurement data ascertained using the ultrasound sensors.

Expediently, the heat exchanger can comprise one or more, in particular aforementioned, thermocouples, wherein the thermocouples are embodied for measuring a temperature in the region of the ultrasound sensors. For example, the respective thermocouple can be arranged in the fluid chamber, on, in particular in, one of the heat-transfer tubes, or on the ultrasound sensor. It is beneficial if the respective thermocouple is connected to the data acquisition unit for the transfer of data. This can be realized via data cables. The data acquisition unit can comprise one or more hardware interfaces for a respective connection of a data cable. Expediently, the respective data cable can run inside of a protective tube, in particular as embodied in the foregoing. The protective tube can thereby be guided to the respective thermocouple. The data cable and signal line can run in a shared protective tube.

A high application practicability can be obtained if an ultrasound signal is emitted into the respective heat-transfer tube, specifically the tube wall thereof, using the ultrasound sensor, and ultrasound signals reflected against an outer wall and an inner wall of the heat-transfer tube are received using the ultrasound sensor, in order to determine a tube wall thickness of the heat-transfer tube. The ultrasound signal is typically emitted using the ultrasound sensor such that the ultrasound signal strikes the outer wall and inner wall in a direction transverse, in particular essentially orthogonal, to the outer wall and/or inner wall and is in particular reflected against said wall.

A determination of the tube wall thickness using the respective ultrasound sensor normally occurs by means of a time-of-flight method. An ultrasound signal is typically emitted using the respective ultrasound sensor, and reflected ultrasound signals are then detected using the ultrasound sensor. The reflected ultrasound signals are normally formed by reflection of the emitted ultrasound signal against interfaces. The interface can, for example, be an outer surface and/or inner surface of a tube wall of a heat-transfer tube. By ascertaining time intervals between the emitted ultrasound signal and reflected ultrasound signals, and/or between reflected ultrasound signals among one another, a thickness of a tube wall into which the ultrasound signal was conducted can be ascertained. The ultrasound signal is typically an ultrasound wave pulse. Typically, an ultrasound signal reflected against the end of the standoff body or against an outer surface of the tube wall, an ultrasound signal reflected against an inner surface of the tube wall, and normally a sequence of reflected ultrasound pulses which correspond to multiple reflections between the inner surface and the outer surface of the tube wall are detected. A time interval between the detected reflected ultrasound pulses of the multiple reflections typically corresponds to twice the tube wall thickness. An emission time of the ultrasound signal, an ultrasound signal reflected against the outer surface of the tube wall, and/or one or more ultrasound signals reflected against the inner surface of the tube wall can be used as time markers in order to determine a respective tube wall thickness using a chronological comparison of the time markers. By factoring in a sonic speed or propagation speed of the ultrasound signal, the tube wall thickness can be determined.

Additional features, advantages, and effects of the invention follow from the following description of an exemplary embodiment. In the drawings which are thereby referenced:

Figure 1:
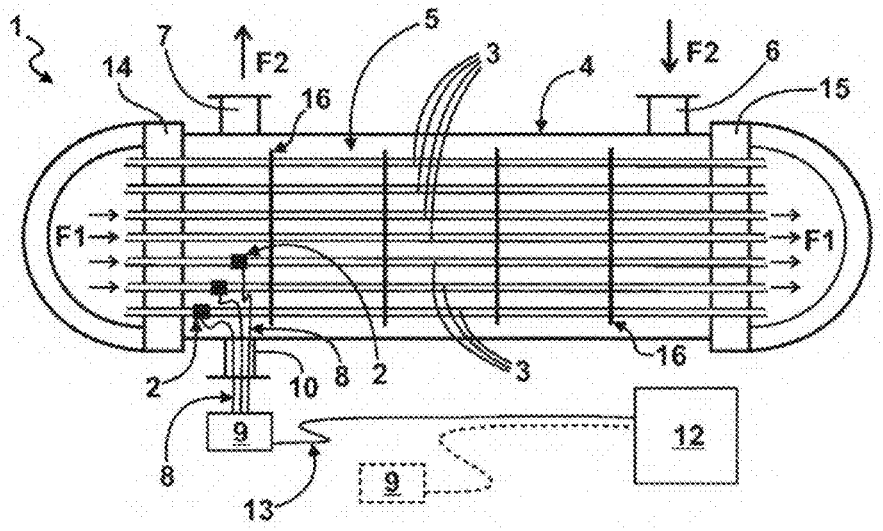
FIG. 1 shows a schematic illustration of a heat exchanger.

In FIG. 1, a heat exchanger 1 is schematically illustrated, wherein the heat exchanger 1 comprises multiple heat-transfer tubes 3 and a fluid chamber 4, wherein the heat-transfer tubes 3 run through the fluid chamber 4 in order to conduct a first fluid F1 through the heat-transfer tubes 3 during operation of the heat exchanger 1 and to conduct a second fluid F2 through the fluid chamber 4 such that said fluid F2 surrounds the heat-transfer tubes, so that heat is transferred between the first fluid F1 and the second fluid F2 through the tube walls of the heat-transfer tubes 3. The fluid chamber 4 forms a fluid chamber cavity 5 between fluid chamber walls and the heat-transfer tubes 3 in order to accommodate the second fluid F2, and through which cavity the second fluid F2 is conducted. The fluid chamber 4 comprises a fluid chamber inlet 6 for feeding the second fluid F2 into the fluid chamber 4, in particular the fluid chamber cavity 5, and a fluid chamber outlet 7 for removing the fluid from the fluid chamber 4, in particular the fluid chamber cavity 5. The second fluid F2 typically has a pressure of more than 30 bar, in particular between 30 bar and 200 bar, and/or a temperature of more than 80° C., in particular between 80° C. and 300° C. Typically, the heat-transfer tubes 3 are guided through the fluid chamber 4 such that they are spaced apart from one another, so that the second fluid F2 can flow through between the heat-transfer tubes 3. The first fluid F1 and/or second fluid F2 can be liquid and/or gaseous water, for example. The heat exchanger 1 can be embodied as a stripper. The heat exchanger 1, in particular the stripper, is often oriented such that a longitudinal extension of the heat-transfer tubes 3 is essentially vertically oriented.

Ultrasound sensors 2 are arranged on a plurality of the heat-transfer tubes 3 in order to determine a tube wall thickness of the respective heat-transfer tube 3 in situ and in operando, that is, during operation of the heat exchanger 1, using the respective ultrasound sensor 2. The respective ultrasound sensor 2 is arranged inside of the fluid chamber 4 on an outer side of the respective heat-transfer tube 3 on said heat-transfer tube 3. In order to withstand high temperatures and/or high pressures in the heat exchanger 1, the ultrasound sensors 2 are designed for a working pressure of more than 30 bar and/or a working temperature of more than 80° C. In particular, the ultrasound sensors 2 are designed to withstand the aforementioned pressure and/or aforementioned temperature of the second fluid F2 and have a corresponding working pressure and a corresponding working temperature. The respective ultrasound sensor 2 is connected to an electronic data acquisition unit 9 via a signal line 8, in order to transfer measurement data to the data acquisition unit 9 during operation of the heat exchanger 1. The data acquisition unit 9 is located outside of the fluid chamber 4, in order to not be adversely affected by the high temperature and the high temperature in the heat exchanger 1. The respective signal line 8 is typically embodied as coaxial cable in order to achieve a transfer of measurement data free of interference. The fluid chamber 4 comprises a signal line feed-through 10, via which the signal lines 8 are guided out of the fluid chamber 4. The signal line feed-through 10 is typically embodied to be fluid-tight with respect to the fluid chamber cavity 5.

Figure 2:
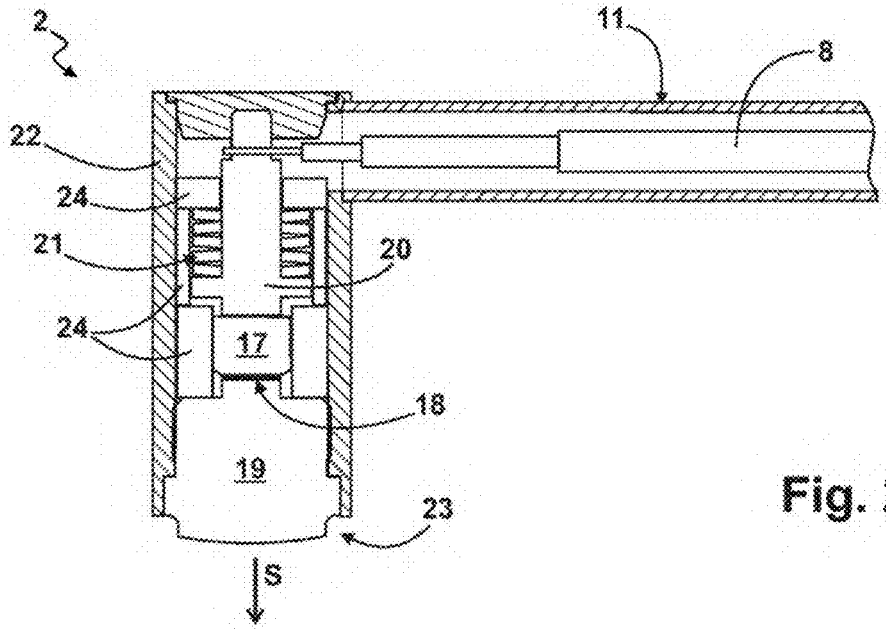
FIG. 2 shows a schematic illustration of an ultrasound sensor in a cross section.

In order to protect the respective signal line 8 against the pressure and the temperature in the fluid chamber 4, in particular of the second fluid F2, the respective signal line 8 runs inside of a protective tube 11 in the fluid chamber 4, as can be seen in FIG. 2. The protective tube 11 runs from the respective ultrasound sensor 2 to the signal line feed-through 10. Typically, the protective tube 11 is connected in a fluid-tight manner, in particular welded, to the respective ultrasound sensor 2 on one side and is connected in a fluid-tight manner, preferably by means of a wedge-bolt connection, to the signal line feed-through 10 on the other side. In this manner, a volume separated from the fluid chamber cavity 5, preferably with a different atmosphere, can be formed using the protective tube 11, in which volume the signal line 8 runs. The protective tube 11 is preferably formed from steel, in particular austenitic steel.

In order to keep line lengths of the signal lines 8 short, it is beneficial if multiple electronic data acquisition units 9 are present, wherein various of the ultrasound sensors 2 are connected to different electronic data acquisition units 9 for the transfer of data. This is illustrated in FIG. 1 by a further electronic data acquisition unit 9 depicted by a dashed line. Analogously to the stated manner, the further electronic data acquisition unit 9 can be connected to further ultrasound sensors 2 arranged on the heat-transfer tubes 3 for the transfer of data.

Typically, an electronic central data unit 12 is provided to which the electronic data acquisition unit 9 or the electronic data acquisition units 9 are connected for a transfer of data. The electronic central data unit 12 is embodied to collect the measurement data of the electronic data acquisition units 9, and preferably to make said data available for a readout by a user. The electronic data acquisition units 9 are typically connected to the electronic central data unit 12 via an electric cable connection 13, in particular a data bus, for the transfer of data.

Normally, the heat-transfer tubes 3 respectively extend between a first tube plate 14 and a second tube plate 15, wherein the tube plates are embodied as being part of fluid chamber walls of the fluid chamber 4 or delimit the fluid chamber cavity 5. The respective heat-transfer tube 3 is guided through the first tube plate 14 and the second tube plate 15. The fluid chamber 4 comprises multiple stabilizing elements 16, typically denoted as baffles, which connect a plurality of the heat-transfer tubes 3 to one another in order to stabilize the heat-transfer tubes 3 using the stabilizing elements 16 during operation of the heat exchanger 1. Expediently, multiple stabilizing elements 16 spaced apart from one another along a longitudinal extension of the heat-transfer tubes 3 can be present, which stabilizing elements 16 are oriented transversely, in particular orthogonally, to the longitudinal extension of the heat-transfer tubes 3. It is expedient if the respective stabilizing element 16, or a fluid-guiding surface formed thereby, closes off an intermediate space between a plurality of the heat-transfer tubes 3 in order to impede a flow of the second fluid F2 through the intermediate space. Often, a large portion of the intermediate spaces between the heat-transfer tubes 3 is closed to a flow by the second fluid F2 in a cross section through the fluid chamber 4 by the respective stabilizing element 16 or the fluid-guiding surface.

It is advantageous if the respective ultrasound sensor 2 is arranged in an arrangement region on the respective heat-transfer tube 3, which arrangement region lies in a first third of a longitudinal extension of the heat-transfer tube 3 inside of the fluid chamber 4 or of the fluid chamber cavity 5 in a flow direction of the first fluid F1 through the heat-transfer tube 3. Preferably, the ultrasound sensor 2 is thereby located between the first tube plate 14 and a first of the stabilizing elements 16 in a flow direction of the first fluid F1 through the heat-transfer tube 3.

FIG. 2 shows a schematic illustration of an ultrasound sensor 2. In particular, the ultrasound sensors 2 are embodied according to FIG. 1. The ultrasound sensor 2 comprises a damping element 17, a piezoelectric crystal 18, and a standoff body 19. The piezoelectric crystal 18 is arranged between the damping element 17 and the standoff body 19 in an emission direction in which an ultrasound signal can be emitted using the ultrasound sensor 2. The damping element 17 is embodied to dampen a mechanical vibration of the piezoelectric crystal 18. The standoff body 19 is embodied to transmit in an emission direction an ultrasound signal produced using the piezoelectric crystal 18, so that the ultrasound signal is located inside of the standoff body 19 for a duration of a switching between an emitting mode and a receiving mode of the ultrasound sensor 2. In the emitting mode, an ultrasound signal can be emitted using the ultrasound sensor 2, in particular the piezoelectric crystal 18. In the receiving mode, an ultrasound signal can be detected using the ultrasound sensor 2, in particular the piezoelectric crystal 18.

The damping element 17 is embodied to be electrically conductive and is electrically connected to an actuating electrode 20 upstream from the damping element 17 in an emission direction S such that the piezoelectric element can be electrically actuated through the damping element 17 via the actuating electrode 20. An electric cathode typically constitutes the actuating electrode 20. The actuating electrode 20 is electrically connected to a signal line 8 for the actuation of the ultrasound sensor 2 or for the transfer of data. The signal line 8 is, as stated in the foregoing, connected to an electronic data acquisition unit 9 for the transfer of data. The signal line 8 is typically a coaxial cable.

The ultrasound sensor 2 comprises a spring element 21 with which the actuating electrode 20, the damping element 17, the piezoelectric crystal 18, and the standoff body 19 are pressed against one another by means of a spring force of the spring element 21. In this manner, a robust connection can be realized, in particular without a bonding agent. The spring element 21 can advantageously be realized using multiple disc springs arranged such that they are connected in series. Expediently, the ultrasound sensor 2 comprises a sensor housing 22 which forms an outer jacket of the ultrasound sensor 2. The sensor housing 22 comprises an outlet opening 23 for the ultrasound signal, wherein the outlet opening 23 is closed off, in particular in a fluid-tight manner, by the standoff body 19. The standoff body 19 is typically connected to the sensor housing 22 in a force-fitting manner, for example using a screw connection.

Between the sensor housing 22 and, respectively, the damping element 17 and the actuating electrode 20, an electric insulating element 24, preferably made of zirconium dioxide, is respectively arranged which typically fully surrounds the damping element 17 and the actuating electrode 20, in order to prevent an electrical contact with the sensor housing 22.

In order to protect the signal transfer from the ultrasound sensor 2 to the electronic data acquisition unit 9 against the second fluid F2, in particular the pressure and/or temperature thereof, the signal line 8 runs, in particular as stated in the foregoing, inside of a protective tube 11. The protective tube 11 connects in a fluid-tight manner to the sensor housing 22, preferably by means of a welded connection, so that the protective tube 11 and the sensor housing 22 define a volume that is separated from the fluid chamber 4 or the fluid chamber cavity 5. In this manner, the ultrasound sensor 2 and the transfer of data between the ultrasound sensor 2 and electronic data acquisition unit 9 can be protected against the second fluid F2.

The piezoelectric crystal 18 can be made of a lead zirconate titanate ceramic (PZT ceramic). The damping element 17 can be made of titanium sinter, preferably with an average pore size between 1 μm and 10 μm. The standoff body 19 can be made of steel, in particular austenitic steel, with a thickness between 2 mm and 10 mm in an emission direction S. The actuating electrode 20 can be formed such that it comprises, in particular is made of, copper. The heat-transfer tubes 3 are typically made of steel, in particular austenitic steel. The ultrasound sensor 2 is preferably embodied to emit an ultrasound signal, in particular an ultrasound wave, with a center frequency of approximately 15 MHz.

Figure 3:
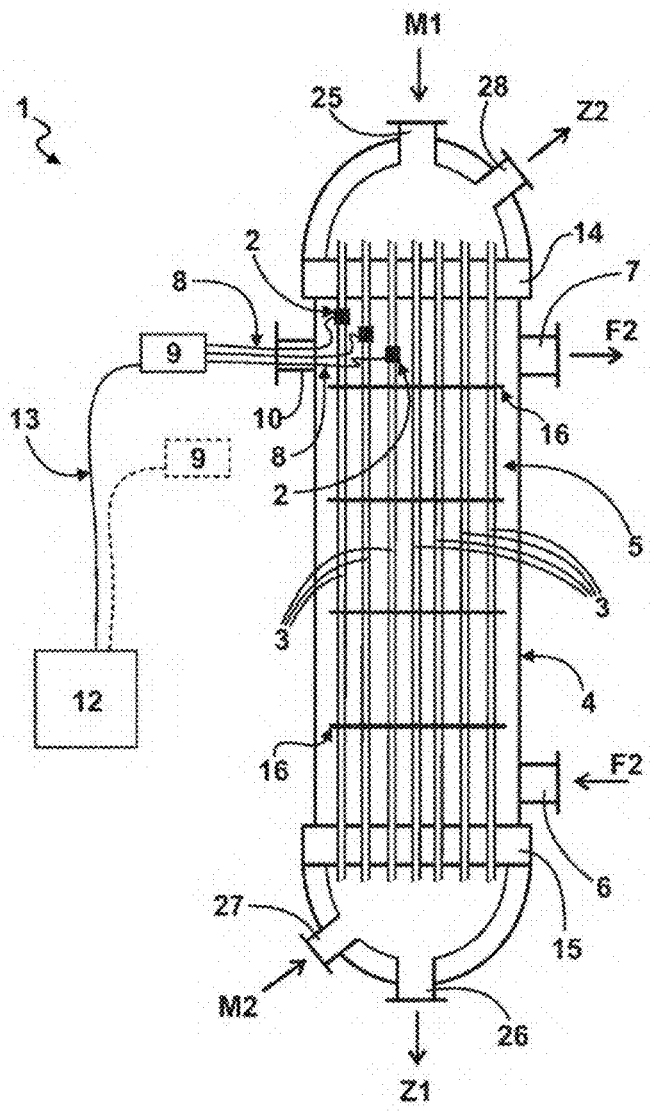
FIG. 3 shows a schematic illustration of a further heat exchanger that is embodied as a stripper.

FIG. 3 shows a schematic illustration of a further heat exchanger 1 that is embodied as a stripper for stripping. Typically, a heat exchanger 1 of this type is used for urea synthesis. The heat exchanger 1 can be embodied according to the explanations with regard to the heat exchanger 1 from FIG. 1, and can in particular comprise ultrasound sensors 2 as explained in relation to FIG. 2 and/or FIG. 4. The heat exchanger 1 is typically oriented such that a longitudinal extension of the heat-transfer tubes 3 is essentially vertically oriented. For urea synthesis, it is provided that the first fluid F1 is formed such that it comprises or is made of a first medium M1 and a second medium M2, wherein inside of the fluid chamber 4 or of the fluid chamber cavity 5, the first medium M1 and second medium M2 flow through the respective heat-transfer tube 3 in opposing flow directions. Normally, the first medium M1 is formed such that it comprises, in particular is made of, urea, ammonium carbamate, and ammonia, and the second medium M2 is formed such that it comprises, in particular is made of, gaseous carbon dioxide (CO2). The first medium is typically liquid. The heat exchanger 1 or stripper normally comprises a plurality, in particular more than 10, preferably more than 50, especially preferably more than 100, particularly preferably more than 1000, heat-transfer tubes 3. The heat exchanger 1 is typically oriented such that the first tube plate 14 is located vertically above the second tube plate 15. Preferably, the respective ultrasound sensor 2 is located between the first tube plate 14 and a first of the stabilizing elements 16.

The heat exchanger 1 comprises a first inlet 25, via which the first medium M1 can be fed into the heat-transfer tubes 3, and a second inlet 27, via which the second medium M2 can be fed into the heat-transfer tubes, so that inside of the fluid chamber 4 or the fluid chamber cavity 5, the media M1, M2 flow through the heat-transfer tubes 3 with opposing flow directions, in order to react with one another. In relation to the fluid chamber cavity 5, the first inlet 25 and the second inlet 27 are connected in a fluid-conducting manner to the heat-transfer tubes 3 at different ends of the heat-transfer tubes 3. For this purpose, the first inlet 25 and the second inlet 27 can respectively be connected in a fluid-conducting manner to a fluid distribution chamber, wherein ends of the heat-transfer tubes 3 are respectively connected in a fluid-conducting manner to the fluid distribution chamber, so that first medium M1 and second medium M2 fed into the respective fluid distribution chamber via the first inlet 25 and second inlet 27, respectively, are conducted into the heat-transfer tubes 3 such that they are distributed to the heat-transfer tubes 3. The heat exchanger 1 comprises a first outlet 26, via which a first product Z1 can be removed from the heat-transfer tubes 3, and a second outlet 28, via which a second product Z2 can be removed from the heat-transfer tubes 3, wherein in relation to the fluid chamber cavity 5, the first outlet 26 and second outlet 28 are connected in a fluid-conducting manner to the heat-transfer tubes 3 at different ends of the heat-transfer tubes 3, preferably in that the first outlet 26 and second outlet 28 are respectively connected in a fluid-conducting manner to one of the fluid distribution chambers, so that a first product Z1 and second product Z2 exiting the heat-transfer tubes 3 can be removed via the respective outlet 26, 28. The first product Z1 is typically urea, in particular in high purity. The second product Z2 is typically gaseous ammonia ($NH_3$) and/or gaseous carbon dioxide ($CO_2$). The second fluid F2 is normally formed such that it comprises, in particular is made of, liquid and/or gaseous water.

Figure 4:
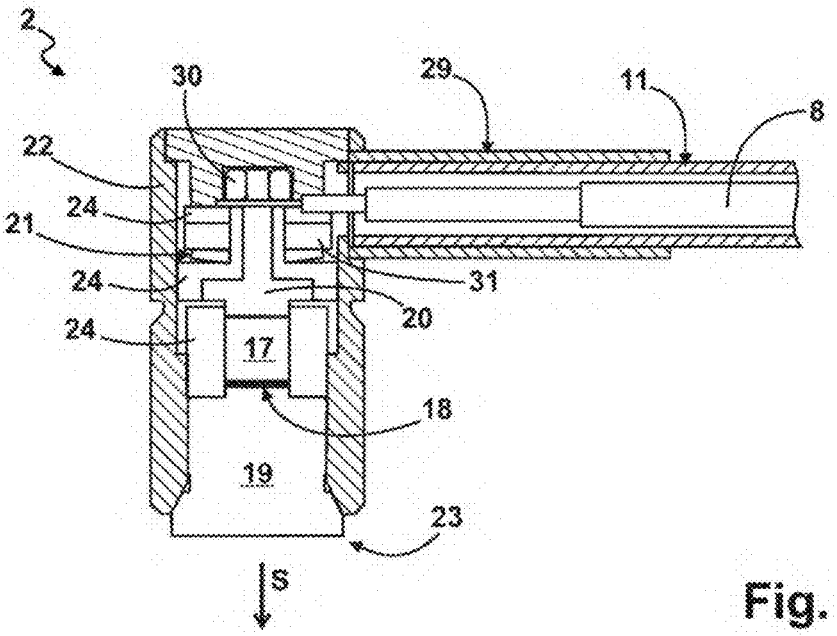
FIG. 4 shows a schematic illustration of a further ultrasound sensor in a cross section.

In FIG. 4, a schematic illustration of a further ultrasound sensor 2 is shown in a cross-section view. The ultrasound sensor 2 can have the same features and effects as the ultrasound sensor 2 from FIG. 2. The ultrasound sensor 2 can be used in a heat exchanger 1 from FIG. 1 and FIG. 3. The construction of the ultrasound sensor 2 from FIG. 4 essentially corresponds to the ultrasound sensor 2 from FIG. 2. In particular, the ultrasound sensor 2 comprises a spring element 21 with which the actuating electrode 20, the damping element 17, the piezoelectric crystal 18, and the standoff body 19 are pressed against one another by means of a spring force of the spring element 21. The spring element 21 is arranged between the actuating electrode and a counter bearing 31, which can be formed by a ring nut. To produce an electrical connection between the signal line 8 and the actuating electrode 20, said line and electrode are connected to one another in a force-fitting manner using a clamping element 30. In contrast to the ultrasound sensor 2 from FIG. 2, the ultrasound sensor 2 comprises an, in particular tubular, connecting piece 29 for the form-fitting accommodation of the protective tube 11, wherein the protective tube 11 is inserted into the connecting piece 29 in a fluid-tight manner. In this manner, an especially robust connection of the signal line 8 to the ultrasound sensor 2 can be realized, for example for a use at particularly high pressure in the fluid chamber cavity 5 or of the second fluid F2. The connecting piece 29 can be formed such that it comprises or is made of steel, in particular austenitic steel. Expediently, the ultrasound sensor from FIG. 2 can also comprise a connecting piece 29 of this type.

If, on one or more of the heat-transfer tubes 3 of the heat exchanger 1, one ultrasound sensor 2 is respectively arranged which is designed for a working pressure of more than 30 bar, in particular between 30 bar and 200 bar, and/or a working temperature of more than 80° C., in particular between 80° C. and 300° C., and wherein the ultrasound sensor 2 is embodied to transfer measurement data to an electronic data acquisition unit 9 during operation of the heat exchanger 1, a tube thickness of the respective heat-transfer tubes 3 can be practicably determined in situ and preferably in operando. This enables an optimized usability of the heat exchanger 1. Particularly if a signal line 8 for the transfer of the measurement signals from the respective ultrasound sensor 2 to the electronic data acquisition unit 9 runs in a protective tube 11 inside of the second fluid F2 and/or if the damping element 17, the piezoelectric crystal 18, and the standoff body 19 are pressed against one another in the ultrasound sensor 2 by means of a spring force of a spring element 21, a particularly high robustness of the in situ determination and, normally, in operando determination of the tube wall thicknesses can be achieved.

The invention claimed is:

1. A heat exchanger, in particular a high-pressure heat exchanger for urea synthesis, comprising multiple heat-transfer tubes for transporting a first fluid in order to transfer heat between the first fluid and a second fluid via the heat-transfer tubes, wherein an ultrasound sensor is respectively arranged on one or more of the heat-transfer tubes for determination of tube wall thicknesses of the heat-transfer tubes, wherein the ultrasound sensor is designed for a working pressure of more than 30 bar and/or a working temperature of more than 80° C., wherein the ultrasound sensor is connected to an electronic data acquisition unit for a transfer of data, in order to transfer measurement data to the electronic data acquisition unit during operation of the heat exchanger.

2. The heat exchanger according to claim 1, wherein the heat exchanger comprises a fluid chamber for accommodating the second fluid, wherein the heat-transfer tubes run inside of the fluid chamber, wherein the data acquisition unit is arranged outside of the fluid chamber.

3. The heat exchanger according to claim 1, wherein the respective ultrasound sensor is connected to the data acquisition unit via a signal line for the transfer of data, wherein the signal line runs, at least in sections, inside of a protective tube, preferably made of metal, in order to protect the signal line.

4. The heat exchanger according to claim 2, wherein on one side a protective tube is welded to a sensor housing of the respective ultrasound sensor, and/or on an other side the protective tube connects to a signal line feed-through, preferably by a wedge-bolt connection, with which signal line-feed through a signal line is guided through a fluid chamber wall of the fluid chamber.

5. The heat exchanger according to claim 3, wherein the protective tube forms a volume separated from the first fluid and second fluid during operation, inside of which volume the signal line runs.

6. The heat exchanger according to claim 1, wherein the respective ultrasound sensor comprises a damping element, a piezoelectric crystal, and a standoff body which are pressed against one another by a spring element.

7. The heat exchanger according to claim 6, wherein the spring element is formed using an arrangement of multiple springs, preferably connected in series.

8. The heat exchanger according to claim 6, wherein, in the respective ultrasound sensor, the damping element is arranged between an electrical actuating electrode and the piezoelectric crystal, wherein the damping element is embodied to be electrically conductive, so that an electrical actuation of the piezoelectric crystal via the actuating electrode can be realized through the damping element.

9. The heat exchanger according to claim 1, wherein the respective ultrasound sensor comprises one or more electric insulating elements for electric insulation, the electric insulating elements comprises zirconium dioxide, between a sensor housing of the ultrasound sensor and, respectively, a piezoelectric crystal and/or a damping element and/or an electrode of the ultrasound sensor.

10. The heat exchanger according to claim 1, wherein, between the respective ultrasound sensor and the heat-transfer tube, a coupler formed that comprises silver, in particular a silver film, is arranged, or no coupler is arranged.

11. The heat exchanger according to claim 1, wherein the respective ultrasound sensor is connected to the respective heat-transfer tube in a force-fitting manner, preferably using a clamping connection.

12. The heat exchanger according to claim 1, wherein multiple ultrasound sensors are connected to the same electronic data acquisition unit for the transfer of data, in order to transfer measurement data to the electronic data acquisition unit during operation of the heat exchanger.

13. A method for operating a heat exchanger, in particular a heat exchanger according to claim 1, wherein, on one or more heat-transfer tubes with which a first fluid is transported in order to transfer heat between the first fluid and a second fluid via the heat-transfer tubes, an ultrasound sensor is respectively arranged with a working pressure of more than 30 bar and/or a working temperature of more than 80° C., wherein a tube wall thickness of the respective heat-transfer tube is determined using the respective ultrasound sensor, wherein measurement data from the respective ultrasound sensor is transmitted to an electronic data acquisition unit during operation of the heat exchanger.

14. The method according to claim 13, wherein the respective ultrasound sensor is operated at a frequency, in particular a center frequency, of more than 10 MHz, in particular between 10 MHz and 30 MHz.

15. The method according to claim 13, wherein for a temperature compensation of an ultrasonic speed of an ultrasound signal, a thickness of a standoff body of at least one of the ultrasound sensors is used as a reference length, and/or a temperature is ascertained using at least one thermocouple.

16. The method according to claim 13, wherein an ultrasound signal is emitted into the respective heat-transfer tube, specifically the tube wall thereof, using the ultrasound sensor, and ultrasound signals reflected against an outer wall and an inner wall of the heat-transfer tube are received using the ultrasound sensor, in order to determine a tube wall thickness of the heat-transfer tube.

* * * * *